US006185278B1

(12) United States Patent
Appleby et al.

(10) Patent No.: US 6,185,278 B1
(45) Date of Patent: Feb. 6, 2001

(54) FOCUSED RADIATION COLLIMATOR

(75) Inventors: Michael P. Appleby, Charlottesville, VA (US); Joseph A. Buturlia, West Boxford, MA (US); Iain Fraser, Holliston, MA (US); Robert F. Lynch, Newburyport, MA (US)

(73) Assignee: Thermo Electron Corp., Waltham, MA (US)

( * ) Notice: Under 35 U.S.C. 154(b), the term of this patent shall be extended for 0 days.

(21) Appl. No.: 09/339,365

(22) Filed: Jun. 24, 1999

(51) Int. Cl.[7] ..... G21K 1/04

(52) U.S. Cl. ..... 378/149; 250/509

(58) Field of Search ..... 378/149, 147, 378/145, 154, 160, 34, 35; 250/363.1, 505.1, 508

(56) References Cited

U.S. PATENT DOCUMENTS

| | | | | |
|---|---|---|---|---|
| 1,164,987 | | 12/1915 | Bucky . | |
| 1,208,474 | | 12/1916 | Caldwell . | |
| 2,133,385 | | 10/1938 | Freeman . | |
| 2,566,998 | | 9/1951 | Strickman . | |
| 2,605,427 | | 7/1952 | Delhumeau . | |
| 2,806,958 | | 9/1957 | Zunick . | |
| 2,824,970 | | 2/1958 | Ledin . | |
| 3,665,186 | | 5/1972 | Tajima | 250/62 |
| 3,717,764 | | 2/1973 | Fujimura et al. | 250/80.71 R |
| 3,909,656 | | 9/1975 | Stachniak . | |
| 3,936,646 | * | 2/1976 | Jonker | 250/509 |
| 4,288,697 | | 9/1981 | Albert | 250/505.1 |
| 4,340,818 | | 7/1982 | Barnes | 250/509 |
| 4,414,679 | | 11/1983 | Liebert et al. | 378/29 |
| 4,429,227 | | 1/1984 | DiBianca et al. . | |
| 4,465,540 | | 8/1984 | Albert | 156/252 |
| 4,688,242 | | 8/1987 | Ema | 378/154 |
| 4,780,382 | | 10/1988 | Stengl et al. . | |
| 4,837,796 | | 6/1989 | Ema | 378/154 |
| 4,856,041 | | 8/1989 | Klein et al. . | |
| 4,951,305 | * | 8/1990 | Moore et al. | 378/147 |
| 4,969,176 | | 11/1990 | Marinus | 378/149 |
| 5,059,802 | | 10/1991 | Filthuth . | |
| 5,062,129 | | 10/1991 | Mulder | 378/156 |
| 5,099,134 | | 3/1992 | Hase et al. | 250/505.1 |
| 5,198,680 | | 3/1993 | Kurakake | 378/149 |
| 5,231,654 | | 7/1993 | Kwasnick et al. | 378/147 |
| 5,231,655 | | 7/1993 | Wei et al. | 378/147 |
| 5,239,568 | | 8/1993 | Greiner . | |
| 5,263,075 | | 11/1993 | McGann et al. . | |
| 5,268,068 | | 12/1993 | Cowell et al. . | |
| 5,291,539 | | 3/1994 | Thumann et al. | 378/154 |

(List continued on next page.)

*Primary Examiner*—David P. Porta
*Assistant Examiner*—Irakli Kiknadze

(57) ABSTRACT

A focused radiation collimator for collimating radiation emitted from a radiation point source located at a substantially known focal distance from the collimator is disclosed. In one embodiment of the disclosed collimator, the collimator is formed by at least two collimator layer groups, aligned, stacked and bonded together immediately adjacent to one another. Each of the collimator layer groups have a plurality of layer group passages arranged there through in a predetermined pattern which is unique to the layer group but which, with the passages of the other collimator layer group in the aligned stack, additively form a plurality of collimator through channels which are substantially aimed at the radiation point source. Each collimating layer group is formed by at least two substantially identical radiation absorbing layers, aligned, stacked and bonded together immediately adjacent to one another. Each of the substantially identical radiation absorbing layers have a plurality of openings arranged there through in substantially the same predetermined pattern which, with the plurality of openings of the other radiation absorbing layer in the aligned stack, additively form the layer group passages. High aspect ratio collimators having very small diameter through channels can be efficiently made in accordance with the teachings of the disclosure.

7 Claims, 6 Drawing Sheets

U.S. PATENT DOCUMENTS

| | | | |
|---|---|---|---|
| 5,293,417 | 3/1994 | Wei et al. . | |
| 5,303,282 | 4/1994 | Kwasnick et al. . | |
| 5,307,394 | 4/1994 | Sokolov . | |
| 5,357,554 | 10/1994 | Schneiderman et al. . | |
| 5,389,473 | 2/1995 | Sokolov . | |
| 5,418,833 | 5/1995 | Logan | 378/154 |
| 5,455,849 | 10/1995 | Logan et al. . | |
| 5,638,817 | 6/1997 | Morgan et al. . | |
| 5,712,483 | 1/1998 | Boone et al. . | |
| 5,814,235 | 9/1998 | Pellegrino et al. . | |

* cited by examiner

FOCUSED RADIATION COLLIMATOR

BACKGROUND OF THE INVENTION

1. Field of the Invention

The present invention generally relates to radiation collimators. More particularly, the present invention relates to a focused radiation collimator made from a plurality of groups of identical radiation absorbing layers.

2. Description of the Prior Art

Scattered X-ray radiation (sometimes referred to as secondary or off-axis radiation) is generally a serious problem in the field of radiography because the secondary or off-axis radiation reduces contrast in resulting radiographic images. Accordingly, radiation collimators, usually in the form of grids, are used for a variety of reasons to filter out off-axis radiation from the radiation intended to be observed. Such collimators have been used to filter out off-axis radiation in medical imaging as well as in astronomical observation applications such as X-radiation or gamma-radiation cameras on board orbiting satellites.

Some collimators are made of a radiation absorbing material having an arrangement of slots or channels with pre-specified aspect ratios (depth versus area of opening). Radiation moving in a direction aligned with the channels passes through the collimator substantially unobstructed, while off-axis radiation moving in a direction that is not aligned with the channels is eventually absorbed by the radiation absorbing material forming the collimator body. The channels of such collimators may be parallel to each other or may be angled so as to be aimed towards a radiation point source which is at a known distance from the collimator. Collimators with angled channels are often referred to as focused collimators.

U.S. Pat. No. 5,606,589 discloses a radiation collimator, in the form of an air cross grid, for absorbing scattered secondary radiation and improving radiation imaging in general for low energy radiation applications such as mammography. The collimator is formed by stacking and aligning a plurality of very thin radiation absorbing foil sheets together to obtain an overall thickness suitable for the low energy application. Each of the foil sheets has a relatively large plurality of precision open air passages extending there through. The precision openings are obtained by photo etching techniques. The foil sheets are precisely stacked so that the precision openings of the metal foil sheets are aligned. In one embodiment, the openings in each metal foil sheet are formed so as to be progressively increasingly angled relative to the planar surfaces of the foil sheet. This is accomplished by photo-etching the foil sheets from both sides with two slightly different photo-etching tools. For example, in a focused collimator containing 24 metal foil sheets made according to the teachings of this invention, 26 different photo etching tools must be used. The use of a relatively large number of photo etching tools can make the process for making such collimators somewhat expensive. Although, the same manufacturing techniques can be used to make a very high aspect ratio collimator comprising 700 or more foil sheet layers, as the number of unique layers increases, the difficulties of aligning a large number of unique layers so that the precisely etched openings of the collimator will be accurately focused at the radiation point source increases tremendously.

SUMMARY OF THE INVENTION

Accordingly, it is a principal object of the present invention to provide a focused radiation collimator.

It is another object of the present invention to provide a high aspect ratio, focused radiation collimator from a plurality of thin, radiation absorbing materials having openings which are precisely photo-etched therein.

These objects are accomplished, at least in part, by providing a focused radiation collimator for collimating radiation emitted from a radiation point source located at a substantially known focal distance from the collimator. The collimator is formed by at least two collimator layer groups, aligned, stacked and bonded together immediately adjacent to one another. Each of the collimator layer groups have a plurality of layer group passages arranged there through in a predetermined pattern which is unique to the layer group but which, with the passages of the other collimator layer group in the aligned stack, additively form a plurality of collimator through channels which are substantially aimed at the radiation point source. Each collimating layer group is formed by at least two substantially identical radiation absorbing layers, aligned, stacked and bonded together immediately adjacent to one another. Each of the substantially identical radiation absorbing layers have a plurality of openings arranged there through in substantially the same predetermined pattern which, with the plurality of openings of the other radiation absorbing layer in the aligned stack, additively form the layer group passages.

Other objects and advantages of the present invention will become apparent to those skilled in the art from the following detailed description read in conjunction with the attached drawing and claims appended hereto.

BRIEF DESCRIPTION OF THE DRAWINGS

The drawings, not drawn to scale, include.

DETAILED DESCRIPTION OF THE INVENTION

Figure 1:
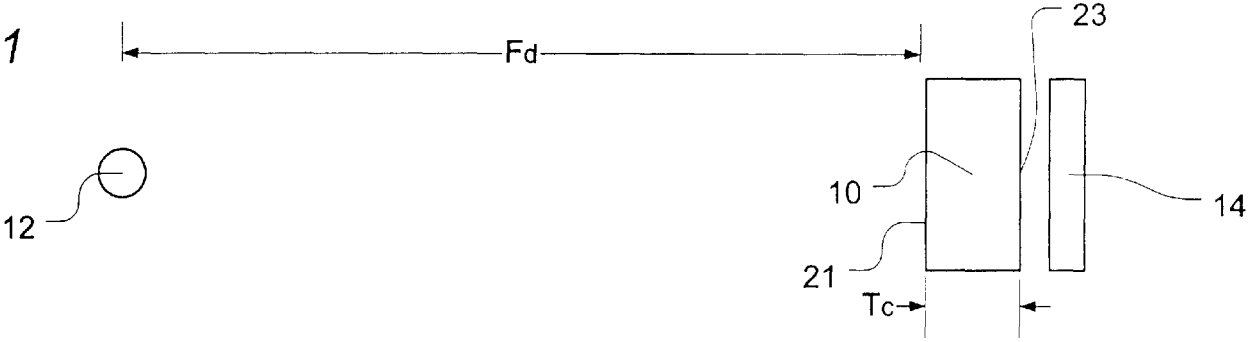
FIG. 1, which is a simple schematic diagram of a focused collimator located remote from a radiation point source.

The present invention is a focused radiation collimator 10 which is typically positioned between a radiation point source 12 and an imaging device 14 as generally illustrated in the schematic diagram labeled FIG. 1. The focused collimator 10 filters substantially all radiation that does not directly emanate directly from the radiation point source 12 to the imaging device 14. As illustrated in FIG. 1, to accomplish this task, the focused radiation collimator 10 is designed to be positioned at a substantially known focal distance $F_d$ from the radiation point source 12.

Figure 2:
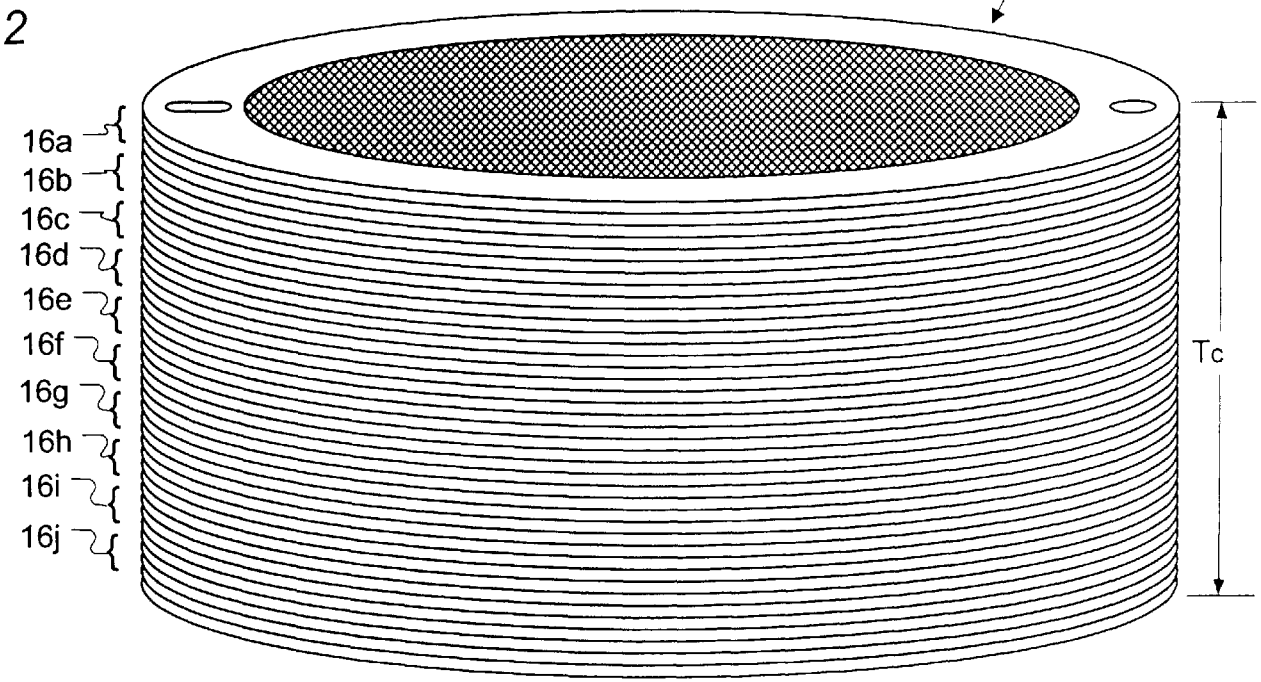
FIG. 2, which is an isometric schematic diagram of the collimator formed from a plurality of collimator groups.
Figure 3:
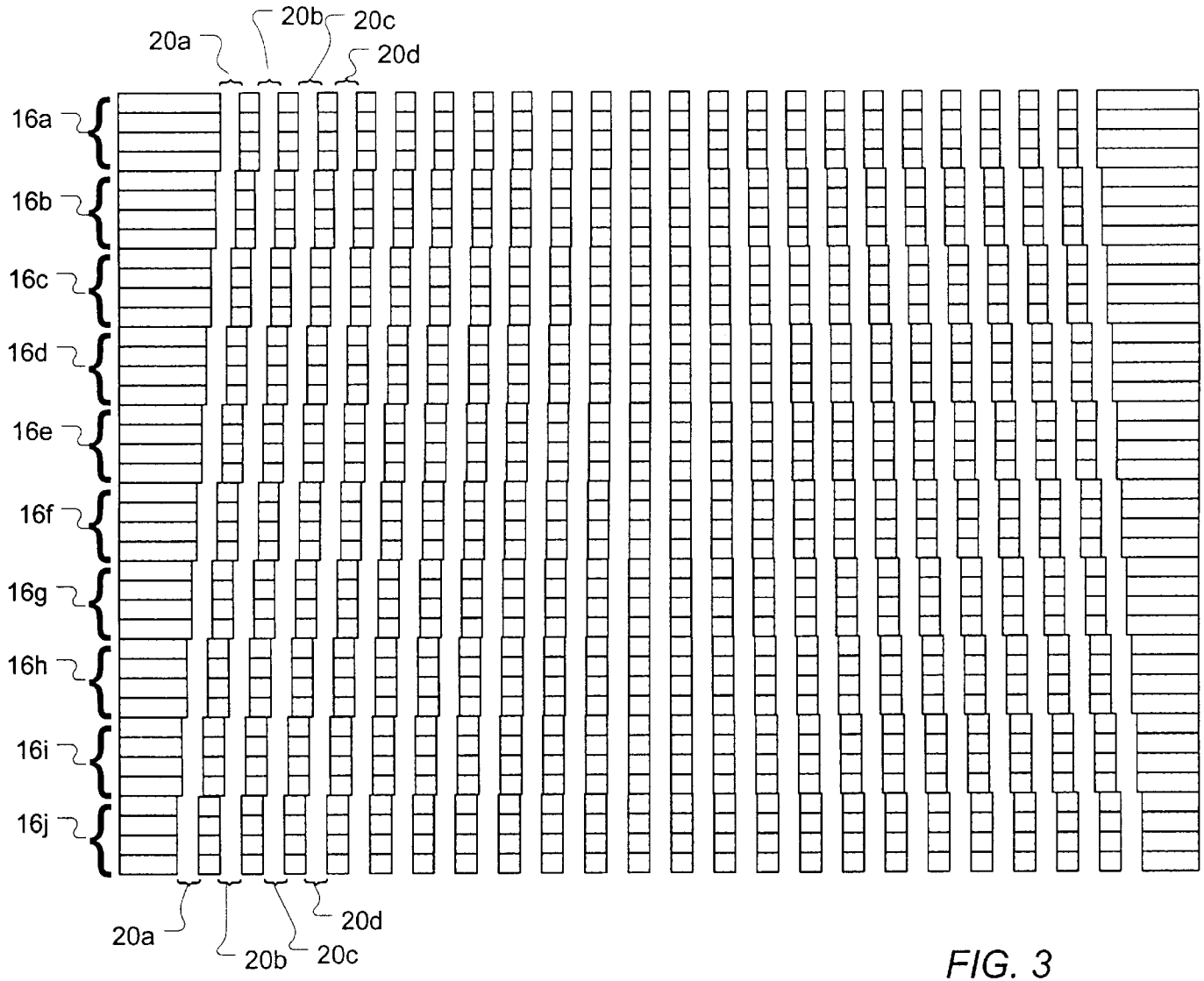
FIG. 3, which is a cross-sectional view of the collimator illustrated in FIG. 2.

An isometric schematic diagram of the collimator 10 of the present invention is illustrated in FIG. 2 and FIG. 3 generally depicts a cross-sectional view of the illustrative embodiment of the focused collimator 10 illustrated in FIG. 2. Referring to FIGS. 2 and 3, the collimator 10 is formed by a plurality of collimator layer groups, such as the 10 layer groups identified as 16*a*–16*j*. The collimator layer groups are aligned, stacked and bonded together immediately adjacent to one another to form the collimator 10 having an overall thickness $T_c$. The overall thickness $T_c$ of the collimator will be dependent on the energy level and wavelength of the radiation to be collimated. Although 10 layer groups are illustrated to form the collimator having thickness $T_c$, any integer number of layer groups greater than one can be used in the present invention to form the collimator with thickness $T_c$. As it will become evident to those skilled in the art, the present invention is particularly useful for efficiently making high aspect ratio collimators involving a large number of groups, such as 50 or more, with very small but precise openings.

Referring to FIGS. 2 through 4B, each of the collimator layer groups, such as layer groups 16*a*, have a plurality of layer group passages, such as 18*a*–18*d* (FIG. 4B), there through. These layer group passages are arranged in a predetermined pattern which is unique to the layer group. However, the pattern of each layer group is arranged so that when the layer groups are stacked together to form the collimator 10, the layer group passages of one layer, together with the passages of the other collimator layer groups, additively form a plurality of collimator through channels, such as 20*a*–20*d* (FIG. 3), which are substantially aimed at the radiation point source 12 located at a distance $F_d$ from the near end 21 of the collimator, the end which is closest to the radiation point source. Those skilled in the art will appreciate that the focal distance $F_d$ could be taken from the remote end 23 of the collimator or some point between the near and remote end.

Figure 4A:
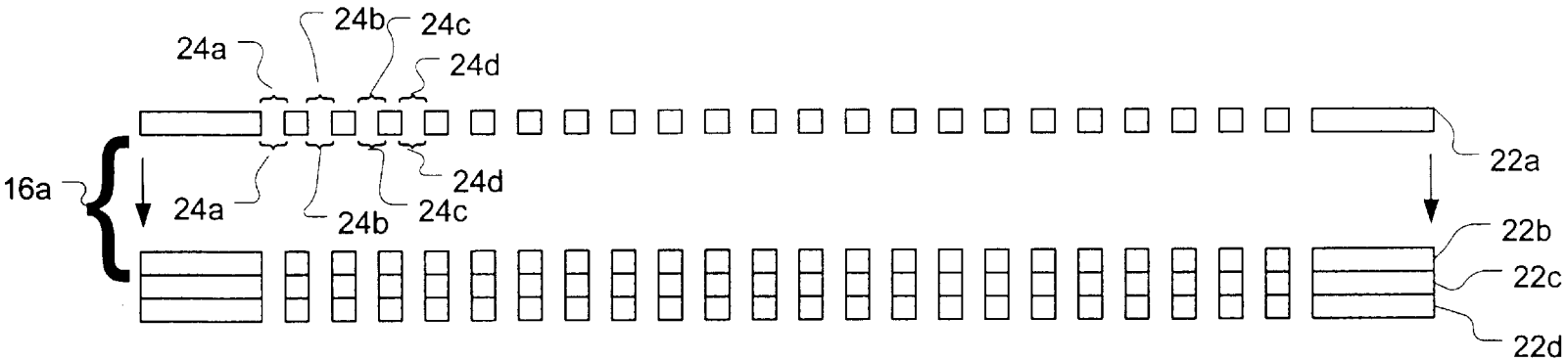
FIG. 4A, which is cross-sectional view illustrating the assembly of a radiation absorbing layer to form a layer group.
Figure 4B:
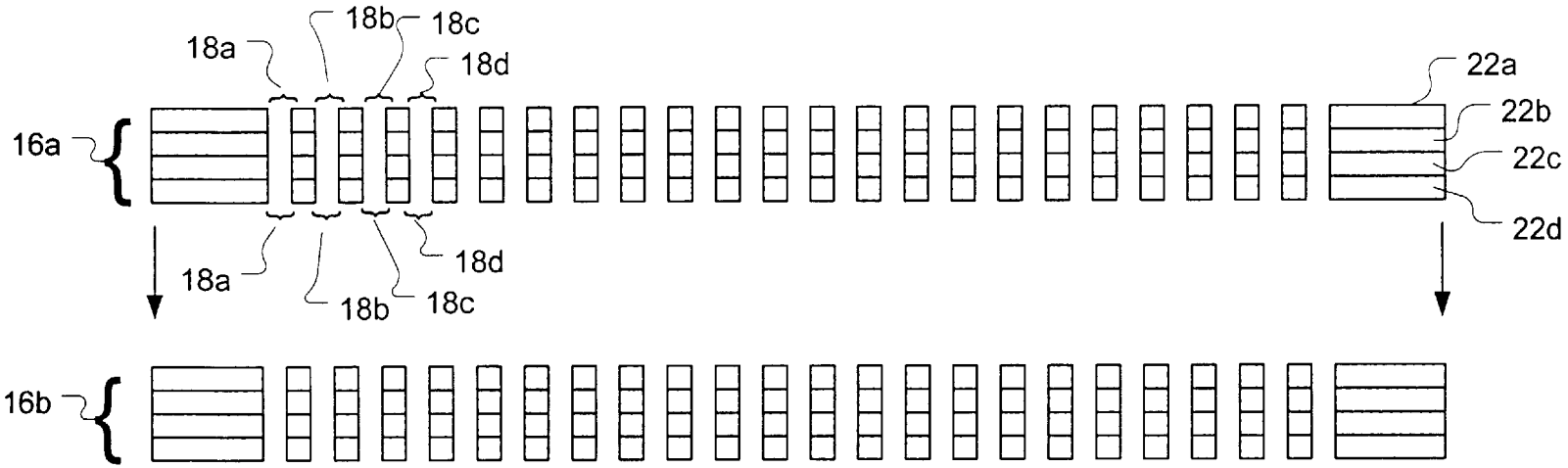
FIG. 4B, which is a cross-sectional view illustrating the assembly of two layer groups to form part of the collimator.

Referring to FIG. 4A, each of the collimator layer groups, such as 16*a*, is formed by a plurality of substantially identical radiation absorbing layers, such as the four radiation absorbing layers identified as 22*a*–22*d*, which are aligned, stacked and bonded together immediately adjacent to one another. Each of the substantially identical radiation absorbing layers have a plurality of openings 24*a*–24*d* arranged there through in substantially the same predetermined pattern. These openings, together with the openings of the other radiation absorbing layers in the aligned stack, additively form the layer group passages, such as 18*a*–18*d*, in the collimator layer groups, such as 16*a*.

Figure 5A:
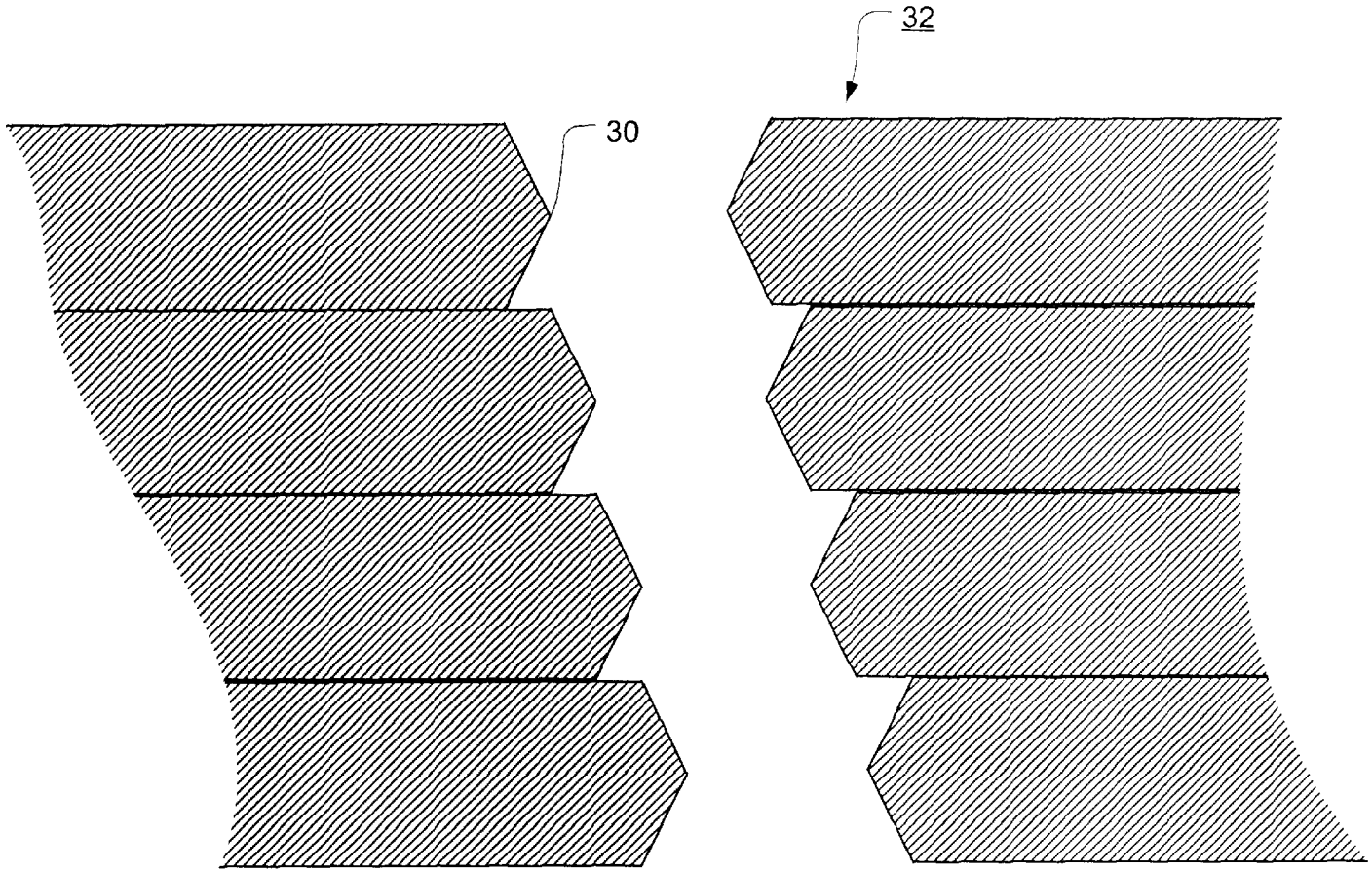
FIG. 5A (PRIOR ART)
FIG. 5A, which is an enlarged partial cross-sectional view of several collimator layers in a conventional multilayer collimator illustrating the necked or hour-glass shaped openings in the several collimator layers caused by etching.
Figure 5B:
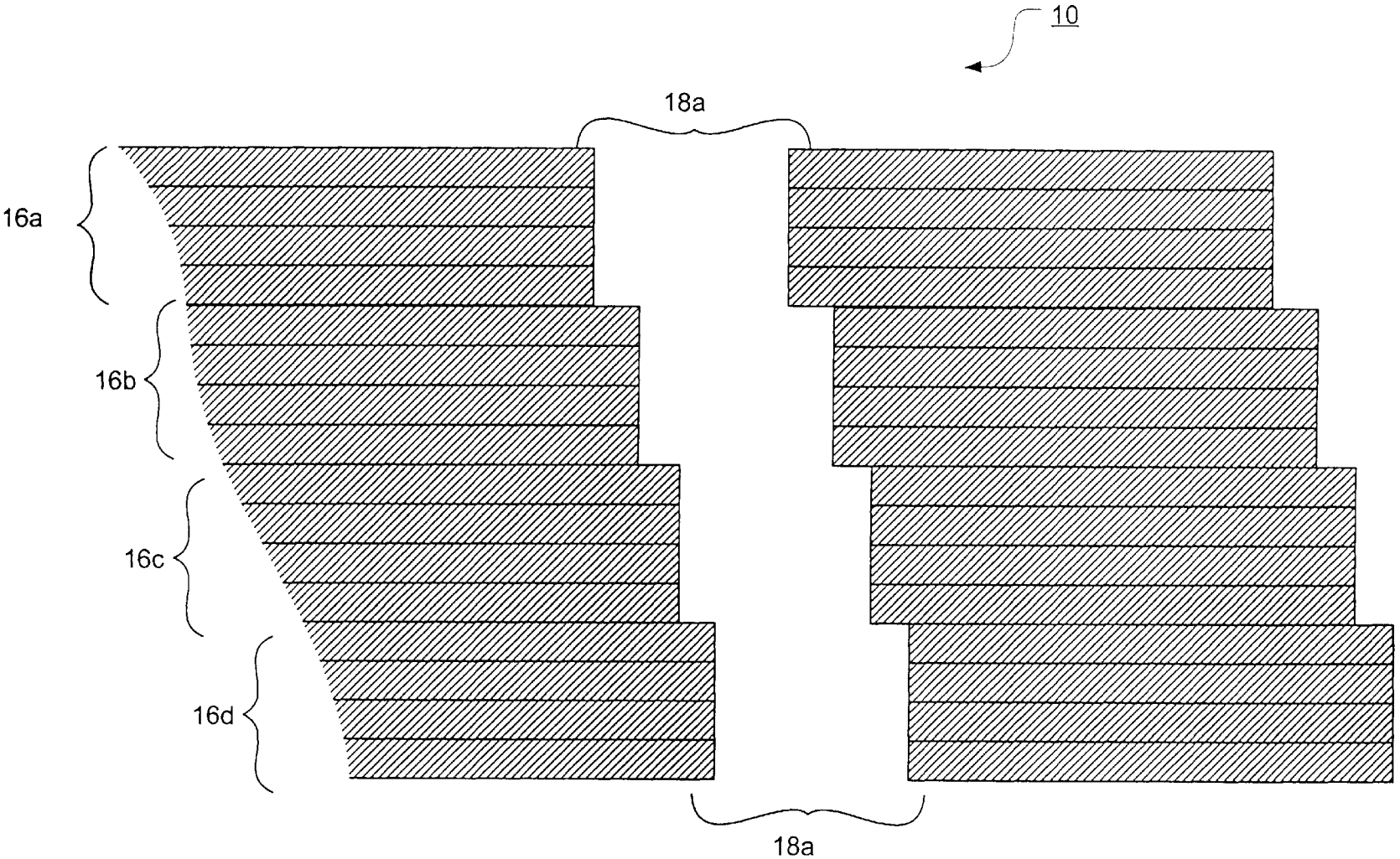
FIG. 5B, which is a partial cross-sectional view corresponding to the view in FIG. 5A illustrating the substantially uniform openings in the collimator layer groups resulting from the use of a plurality of thin radiation absorbing layers.

Each of the radiation absorbing layers, such as 24*a*, is preferably formed from a radiation absorbing material such as tungsten or beryllium-copper alloy and are preferably about 0.20 mm thick. The use of very thin radiation absorbing layers to form the collimator layer groups and the collimator allows the collimator to have precision photo-etched openings. Those skilled in the art will appreciate that the precision of an etched opening in a metal workpiece is dependent upon the thickness of the metal workpiece. Because the removal of metal by etching is a result of a surface reaction between the metal surface and the etching solution, the etching of the metal workpiece to produce an opening in the metal workpiece will not result in a completely uniform opening with flat or straight walls. In other words, because the etching of the region intended to be the opening is not uniformly and simultaneously occurring, the etched opening will generally have a necked or hour-glass shape at the end of etching as illustrated in FIG. 5A. As the thickness of the metal workpiece increases, the severity of the necking increases. To minimize the necking, it is preferable to use as thin a metal workpiece as possible and to etch simultaneously from both sides of the workpiece and stack a plurality of thin radiation absorbing metal etched workpieces together to form a collimator layer group, such as 16*a*. Under these conditions, the necking can be minimized as illustrated in FIG. 5B and the openings in the collimator layer groups will be more uniform than the openings in the collimator layers 30 (FIG. 5A) in a conventional focused collimator 32. However, by reducing the thickness of the metal workpiece, more workpieces or radiation layers are necessary to construct a collimator.

The precision photo-etching of openings in the radiation absorbing layers is described in great detail in co-pending U.S. patent application Ser. No. 09/191,864, owned by the assignee hereof. The disclosure of that application is incorporated by reference in its entirety. However, such steps are outlined herein for the sake of convenience.

To make a radiation absorbing layer for the present invention, such as layer 22*a* in FIG. 4A, for the collimator, a photo sensitive resist material coating (not shown) is applied to the surfaces of an etching blank. After the etching blank has been provided with a photo-resist material coating on its surfaces, glass mask tools or negatives, containing a negative of the desired pattern of openings and registration features to be etched in the blank are applied in alignment with each other and in intimate contact with the surfaces of the blank. Preferably, the mask tools or negatives are made from glass. Glass is the preferred material for the mask tools because it has a low thermal expansion coefficient. Materials other than glass could be used provided that such materials transmit radiation such as ultraviolet light and have a low coefficient of thermal expansion. The mask tools may be configured to provide any shaped opening desired and further configured to provide substantially any pattern of openings desired.

The resulting sandwich of two negative mask tools aligned in registration flanking both surfaces of the etching blank is next exposed to radiation in the form of ultraviolet light projected on both surfaces through the mask tools to expose the photo-resist coatings to ultraviolet radiation. The photo-resist exposed to the ultraviolet light is sensitized while the photo-resist not exposed because such light blocked by mask features is not sensitized. The mask tools are then removed and a developer solution is applied to the surfaces of the blank to develop the exposed photo-resist material.

Once the photo-resist is developed, the etching blanks are passed one or more times through and etching device which applies an etching solution to the surfaces of the etching blank. The etching solution reacts with radiation absorbing material not covered by the photo-resist to form the precision openings therein.

Identical radiation absorbing layers having the precise openings etched therein are stacked in alignment and bonded together using a suitable adhesive or by diffusion bonding. The identical radiation absorbing layers, which form a collimator layer group, are stacked and bonded in alignment with other collimator layer groups to form the collimator of the present invention. Because the collimator contains a plurality of identical radiation absorbing layers, the number of different photo-etching mask tools can be reduced significantly while not compromising the overall precision of the through collimator openings, such as 20*a*–20*d*. Because the number of different photo-etching mask is reduced, the cost of manufacture can be reduced.

A high aspect ratio, focused collimator suitable for collimating gamma radiation was made by stacking, aligning and bonding 60 unique collimator layer groups together. Each of the collimator layer groups were formed by 12 0.203 mm thick substantially identical tungsten radiation absorbing layers which were stacked, aligned and bonded together. Each of the radiation absorbing layers which were members of a collimator layer group had 5,813 circular shaped openings photo-etched therein arranged in a substantially identical hexagonal pattern. The circular shaped openings of the 12 radiation absorbing layers of the first collimating layer group had a 0.33 mm diameter and the centers of adjacent circular openings were separated by 0.50 mm. The 12 radiation absorbing layers of the $60^{th}$ collimating layer group had a 0.347 mm diameter and the centers of adjacent circular openings were separated by 0.525 mm. The focal distance of the collimator was approximately 300 cm measured from the near end of the collimator.

Figure 5C:
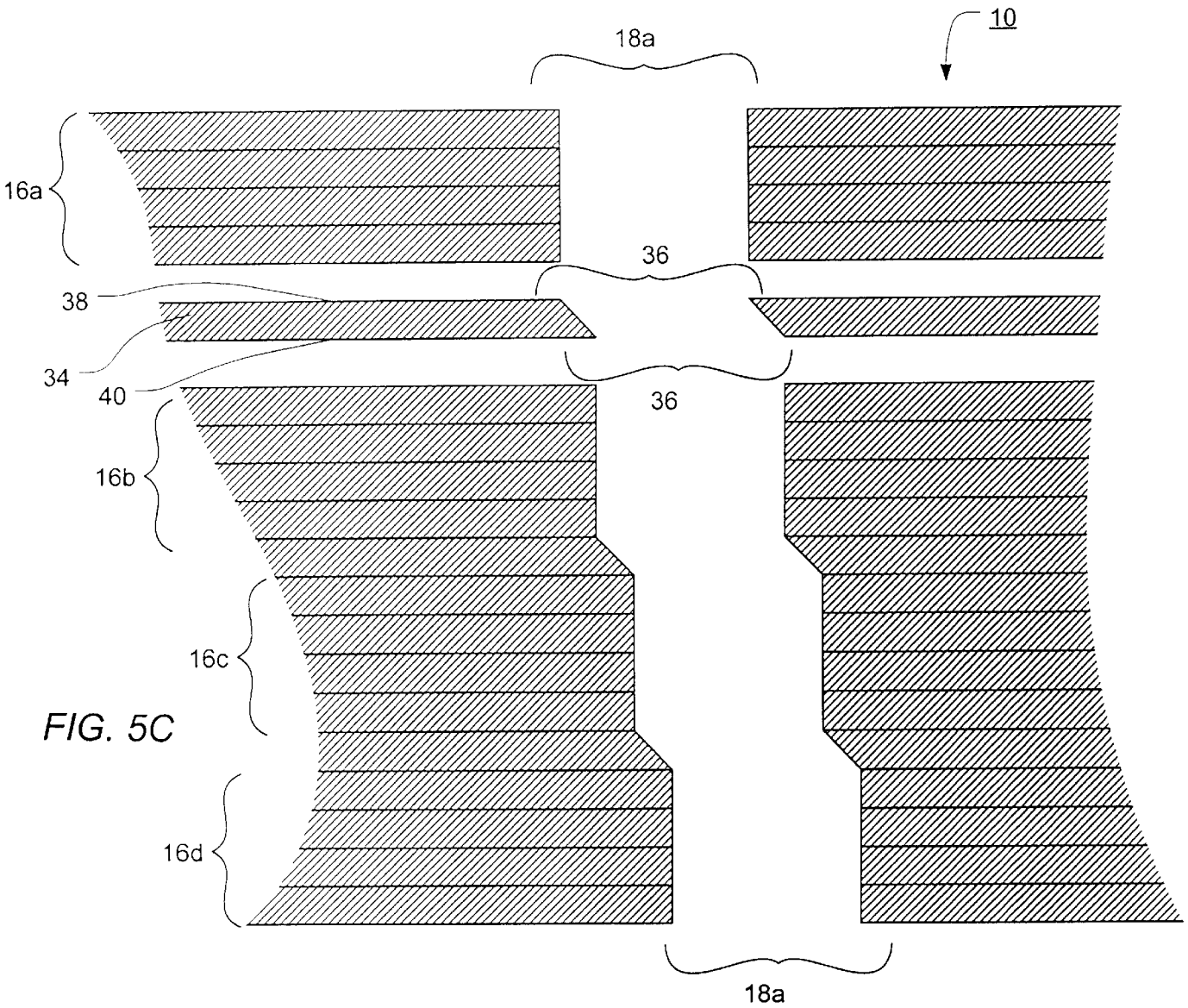
FIG. 5C, which is a partial cross-sectional view illustrating an alternative embodiment of the present invention which utilizes transition layers between the plurality of like thin radiation absorbing layers which form the collimator layer groups.

In an alternative embodiment illustrated in the partial cross-sectional view of FIG. 5C, the construction of the focused radiation collimator 10 is similar to that illustrated in the partial cross-sectional view of FIG. 5B. However, instead of the adjacent arrangement of the collimating layer groups as shown in FIG. 5B, a radiation absorbing transition layer 34 is positioned in alignment with and bonded between each of the collimator layer groups, such as 16*a* and 16*b*, for example. The transition layer 34 has plurality of contoured openings such as 36 arranged in a predetermined transition pattern which link the plurality of layer group passages of the two adjacent collimator layer groups. The contoured openings for linking the two layer group passages may be obtained by photo etching a first side 38 of the transition layer with the photo etching mask tool used to make the openings in the radiation absorbing layers forming collimator layer group 16*a*, while a second side 40 of the transition layer 34 is photo etched using the photo etching mask tool used to make the openings in the radiation absorbing layers forming the other collimator layer group 16*b*. The transition layer 34 is intended to eliminate any effects which may be caused by the substantial stair-step relationship between collimating layer groups.

Accordingly, in view of the disclosure herein, those skilled in the art will now be able to efficiently manufacture a high aspect ratio focused radiation collimator. It will thus be seen that the objects and advantages set forth above and those made apparent from the preceding descriptions, are efficiently attained and, since certain changes may be made in the above construction without departing from the scope of the invention, it is intended that the matter contained in the above description or shown in the accompanying drawings shall be interpreted as illustrative and not in a limiting sense. It is also to be understood that the following claims are intended to cover all of the generic and specific features of the invention herein described, and all statements of the scope of the invention which, as a matter of language, might be said to fall there between.

What is claimed is:

1. A focused radiation collimator for collimating radiation emitted from a radiation point source located at a substantially known focal distance from the collimator, the collimator comprising:

N collimator layer groups, where N is an integer greater than one, aligned, stacked and bonded together immediately adjacent to one another to form a collimator body, each of the N collimator layer groups having a plurality of layer group passages arranged there through in a predetermined pattern which is unique to the layer group but which, with the passages of other collimator layer groups in the aligned stack of N collimator layer groups, additively form a plurality of collimator through channels which are substantially aimed at the radiation point source, and wherein each of the collimating layer groups further comprises:

M substantially identical radiation absorbing layers, where M is an integer greater than one, aligned, stacked and bonded together immediately adjacent to one another, each of the M substantially identical radiation absorbing layers having a plurality of openings arranged there through in substantially the same predetermined pattern which, with the plurality of openings of the other radiation absorbing layers in the aligned stack of M substantially identical radiation absorbing layers, additively form the layer group passages.

2. The collimator of claim 1, wherein the radiation absorbing layers are formed from a chemically etchable material selected from the group consisting of beryllium copper alloy and tungsten.

3. The collimator of claim 2, wherein N is 60, wherein M is 12, wherein each of the M identical radiation absorbing layers is approximately 0.20 mm thick, and wherein the focal distance is 300 cm from the collimator's near end.

4. The collimator of claim 3, wherein the openings in the radiation absorbing layers are substantially circular shaped.

5. The collimator of claim 4, wherein the openings are arranged in a hexagonal pattern.

6. A focused radiation collimator for collimating radiation emitted from a radiation point source located at a substantially known focal distance from the collimator, the collimator comprising:

at least two collimator layer groups, aligned, stacked and bonded together immediately adjacent to one another, each of the collimator layer groups having a plurality of layer group passages arranged there through in a predetermined pattern which is unique to the layer group but which, with the passages of the other collimator layer group in the aligned stack, additively form a plurality of collimator through channels which are substantially aimed at the radiation point source, and wherein each collimating layer group further comprises:

at least two substantially identical radiation absorbing layers, aligned, stacked and bonded together immediately adjacent to one another, each of the substantially identical radiation absorbing layers having a plurality of openings arranged there through in substantially the same predetermined pattern which, with the plurality of openings of the other radiation absorbing layer in the aligned stack, additively form the layer group passages.

7. A focused radiation collimator for collimating radiation emitted from a radiation point source located at a substantially known focal distance from the collimator, the collimator comprising:

at least two collimator layer groups in an aligned stack, each of the collimator layer groups having a plurality of layer group passages arranged there through in a predetermined pattern which is unique to the layer group but which, with the passages of the other collimator layer group in the aligned stack, additively form a plurality of collimator through channels which are substantially aimed at the radiation point source, and wherein each collimating layer group further comprises:

at least two substantially identical radiation absorbing layers, aligned, stacked and bonded together immediately adjacent to one another, each of the substantially identical radiation absorbing layers having a plurality of openings arranged there through in substantially the same predetermined pattern which, with the plurality of openings of the other radiation absorbing layer in the aligned stack, additively form the layer group passages; and a radiation absorbing transition layer positioned in alignment with and bonded between the at least two collimator layer groups, the transition layer having plurality of contoured openings arranged in a predetermined transition pattern which link the plurality of layer group passages of the two collimator layer groups adjacent thereto.

* * * * *